United States Patent [19]

Lopez et al.

[11] 4,050,231

[45] Sept. 27, 1977

[54] BICENTENNIAL EAGLE CLOCK

[75] Inventors: Aaron Lopez; Juan Lopez, both of South Gate, Calif.

[73] Assignee: The Raymond Lee Organization, Inc., New York, N.Y. ; a part interest

[21] Appl. No.: 729,596

[22] Filed: Oct. 4, 1976

[51] Int. Cl.[2] ..... G04B 21/08; G04B 37/00

[52] U.S. Cl. ..... 58/13; 58/2; 58/53

[58] Field of Search ..... 58/2, 7–13, 58/53

[56] References Cited

U.S. PATENT DOCUMENTS

| | | | |
|---|---|---|---|
| 352,180 | 11/1886 | Burges | 58/8 |
| 1,439,075 | 12/1922 | Dressler | 58/50 R |
| 1,508,876 | 9/1924 | Dressler | 58/50 R |

*Primary Examiner*—E. S. Jackmon
*Attorney, Agent, or Firm*—Howard I. Podell

[57] ABSTRACT

A clock mounted in a wall of a bell suspended from a horizontal support that is mounted on spaced pillars fixed to a base. A molded figure of an outstretched eagle is fittedabove the horizontal support. A bell hammer is suspended from a horizntal axle that is rotatably fixed at one end, internally to a wall of the bell and at the other end of the axle to the chime mechanism of the clock so that the bell hammer strikes the wall of the bell when actuated by the chime mechanism of the clock.

1 Claim, 3 Drawing Figures

BICENTENNIAL EAGLE CLOCK

SUMMARY OF THE INVENTION

My invention is a clock mounted in a wall of a bell suspended from a horizontal support that is mounted on spaced pillars fixed to a base. A molded figure of an outstretched eagle is fitted above the horizontal support. A bell hammer is suspended from a horizontal axle that is rotatably fixed at one end, internally to a wall of the bell and at the other end of the axle to the chime mechanism of the clock so that the bell hammer strikes the wall of the bell when actuated by the chime mechanism of the clock.

The eagle is preferably sculpted to represent an outstretched American Eagle and the bell may be formed with a crack to symbolize the Liberty Bell, with suitable patriotic symbols marked on the horizontal support. A plaque, suitable for engraving, may be externally fixed to the base of the unit.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
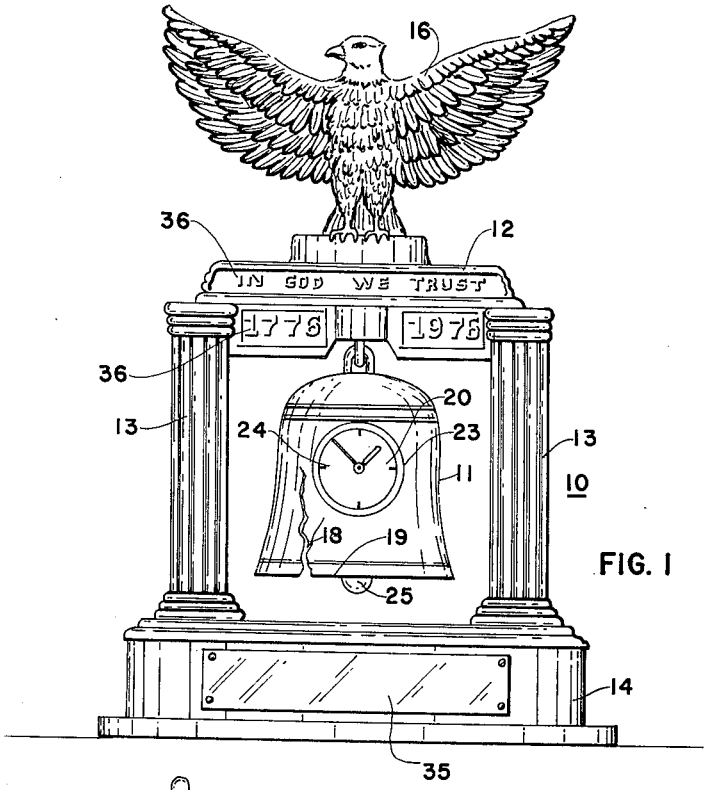
FIG. 1 is an elevation view of the invention.
Figure 2:
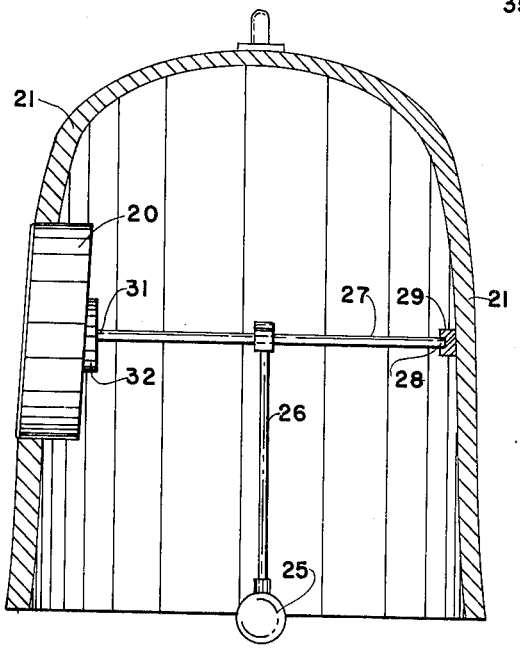
FIG. 2 is a sectional view of the bell.
Figure 3:
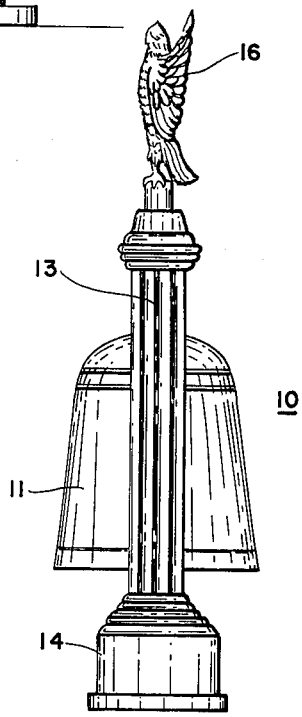
FIG. 3 is an end view of the invention.

Turning now descriptively to the drawings, in which similar reference characters denote similar elements throughout the several views, FIGS. 1–3 illustrate the assembly 10. A bell 11 is hung from a horizontal support member 12 mounted to a pair of spaced pillars 13 fixed to a base 14.

A sculpted figure 16 of an outstretched eagle is mounted above support member 12 and designed to represent the American Eagle. The sidewall 23 of bell 11 is formed with an open crack section 18 extending from the rim 19 of the bell to represent the Liberty Bell.

A clock 20 internally fitted with a chime mechanism 32 is fitted into a circular opening 23 of bell wall 23 with the face 24 of clock 20 visibly located.

A bell hammer 25 is suspended by an arm 26 fixed to a lateral shaft 27, one end 28 of which is pivotably mounted on a bearing 29 on an inside surface of bell wall 21 opposite clock 20. The other end 31 of shaft 27 is fixed to the chime mechanism 32 of clock 20 so that shaft 27 and attached hammer 25 are oscillated by chime mechanism 32 to cause hammer 25 to strike bell wall 21 when the chime mechanism 31 is acuated.

A flat plaque 35, suitable for engraving is externally mounted to base 14.

Decorative indicia 36 of a patriotic nature are embossed on horizontal support member 12.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A patriotic display clock assembly comprising a bell hung from a support member mounted on spaced pillars to a base, with a clock mounted on the wall of the bell, in which a bell hammer is suspended inside the bell by a shaft to which it is fixed, said shaft rotatably mounted at one end to the bell and fixed at the other end to the mechanism of the clock so as to cause the hammer to strike the bell wall when the shaft is oscillated by the clock mechanism.

* * * * *